US007451697B2

(12) United States Patent
Moore

(10) Patent No.: US 7,451,697 B2
(45) Date of Patent: Nov. 18, 2008

(54) PRINTING SYSTEM

(75) Inventor: Steven R. Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 446 days.

(21) Appl. No.: 11/166,299

(22) Filed: Jun. 24, 2005

(65) Prior Publication Data

US 2006/0291930 A1 Dec. 28, 2006

(51) Int. Cl.

| | |
|---|---|
| ***B41F 5/16*** | (2006.01) |
| ***B41F 5/18*** | (2006.01) |
| ***B41M 1/14*** | (2006.01) |
| ***G03G 15/14*** | (2006.01) |

(52) U.S. Cl. ..... 101/181; 101/219; 399/297; 399/302; 399/308; 399/384

(58) Field of Classification Search ..... 101/181, 101/182, 184, 219, DIG. 33, DIG. 48; 399/302, 399/308, 384, 297

See application file for complete search history.

(56) References Cited

U.S. PATENT DOCUMENTS

| | | | | |
|---|---|---|---|---|
| 4,437,402 | A * | 3/1984 | Fischer | 101/181 |
| 4,579,446 | A | 4/1986 | Fujino et al. | |
| 4,587,532 | A | 5/1986 | Asano | |
| 4,836,119 | A | 6/1989 | Siraco et al. | |
| 5,004,222 | A | 4/1991 | Dobashi | |
| 5,080,340 | A | 1/1992 | Hacknauer et al. | |
| 5,095,342 | A | 3/1992 | Farrell et al. | |
| 5,159,395 | A | 10/1992 | Farrell et al. | |
| 5,208,640 | A | 5/1993 | Horie et al. | |
| 5,272,511 | A | 12/1993 | Conrad et al. | |
| 5,326,093 | A | 7/1994 | Sollitt | |
| 5,435,544 | A | 7/1995 | Mandel | |
| 5,473,419 | A | 12/1995 | Russel et al. | |
| 5,489,969 | A | 2/1996 | Soler et al. | |
| 5,504,568 | A | 4/1996 | Saraswat et al. | |
| 5,525,031 | A | 6/1996 | Fox | |
| 5,557,367 | A | 9/1996 | Yang et al. | |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Anthony H. Nguyen
*Assistant Examiner*—Leo T Hinze
(74) *Attorney, Agent, or Firm*—Fay Sharpe LLP

(57) ABSTRACT

A printing system is provided that includes one or more printing modules, the one or more printing modules including a media web transport input; a media web image transfer point; a media web transport output; a primary image transfer system; a secondary image transfer system; and an intermediate image transfer point coupling the primary image transfer system and a secondary image transfer system. The secondary image transfer system is adapted to accept an image from the primary image transfer system at the intermediate image transfer point, and the secondary image transfer system is adapted to transfer the image from the secondary image transfer system to a media web at the media transfer point. The media web transport input and media web transport output provide a media web path to route the media web from the media web transport input to the media web transfer-point, and from the media web transfer point to the media web transport output.

28 Claims, 9 Drawing Sheets

U.S. PATENT DOCUMENTS

| | | | | |
|---|---|---|---|---|
| 5,568,246 | A | 10/1996 | Keller et al. | |
| 5,570,172 | A | 10/1996 | Acquaviva | |
| 5,596,416 | A | 1/1997 | Barry et al. | |
| 5,629,762 | A | 5/1997 | Mahoney et al. | |
| 5,710,968 | A | 1/1998 | Clark et al. | |
| 5,778,377 | A | 7/1998 | Marlin et al. | |
| 5,884,910 | A | 3/1999 | Mandel | |
| 5,983,062 | A * | 11/1999 | Sameshima | 399/302 |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,463,248 | B1 * | 10/2002 | Jia et al. | 399/302 |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,731,898 | B1 * | 5/2004 | Landa et al. | 399/298 |
| 6,745,002 | B2 * | 6/2004 | Nakashima et al. | 399/307 |
| 6,819,906 | B1 | 11/2004 | Herrmann et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,156, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.

* cited by examiner

PRINTING SYSTEM

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. dejong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8,2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005 entitled "PRINTING SYSTEMS", by Kristine A. German et al.;

U.S. application Ser. No. 11/137,634, filed May 25, 2005, entitled "PRINTING SYSTEM", by Robert M. Lofthus et al.;

U.S. application Ser. No. 11/137,251, filed May 25, 2005, entitled "SCHEDULING SYSTEM", by Robert M. Lofthus et al.;

U.S. C-I-P application Ser. No. 11/137,273, filed May 25, 2005, entitled "PRINTING SYSTEM", by David G. Anderson et al.;

U.S. Publication No. 2006-0066885-A1, published Dec. 7, 2006, entitled "INTER-SEPARATION DECORRELATOR", by Edul N. Dalal et al.;

U.S. Publication No. 2006-0274334-A1, published Dec. 7, 2006, entitled "LOW COST ADJUSTMENT METHOD FOR PRINTING SYSTEMS", by Michael C. Mongeon;

U.S. Publication No. 2006-0280517A1, published Dec. 14, 2006, entitled "WARM-UP OF MULTIPLE INTEGRATED MARKING ENGINES", by Bryan J. Roof et al.;

U.S. application Ser. No. 11/156,778, filed Jun. 20, 2005, entitled "PRINTING PLATFORM", by Joseph A. Swift;

U.S. Publication No. 2006-0285159-A1, published Dec. 21, 2006, entitled "METHOD OF ORDERING JOB QUEUE OF MARKING SYSTEMS", by Neil A. Frankel.

BACKGROUND

The present disclosure relates to a continuous feed printing system that integrates one or more printing system modules. A continuous feed (CF) printing system prints on a band or roll of paper as opposed to a sheet printing system that prints on discrete sheets of media. FIG. 1 illustrates a continuous feed printing system that incorporates a media roll input 2, media roll input adapter 4, multiple printing modules 6, 8,10, and 12, a media output adapter 14 and a media roll output 16. The media roll input 2 unwinds in a clockwise direction as the web of paper 18 is fed by the input adapter 4 to a first printing module 6. The paper web 18 continues to proceed through a second 8, third 10 and fourth 12 printing modules. The web 18 continues to be processed through the output adapter 14 which feeds the paper web onto an output roll 16. Any paper cutting required is performed external to the CF printing system illustrated in FIG. 1. Other variations of a CF printing system are available, such as the printing system disclosed in U.S. Pat. No. 6,786,149, issued to Lomoine et al.

Integrated sheet printing systems, such as the system illustrated in FIG. 2 and FIG. 3, serve as platforms for entry level production printing with minimal investment. Integrated systems typically use two or more marking engines 20, 22, and 24 which are modular in design and construction. The marking engines are integrated with a sheet feeder module 26 and a finisher module 28 by way of an integrated track to route individual cut sheets of media from the sheet feeder module 26 to one or more marking engines 20, 22, and 24 for marking. After all marking has been completed the integrated track routes the printed media to the finisher module 28. Cost benefits of this printing system are related to the modularity of the modules used. For example, the marking engines can be configured to include black only, color, custom color and/or monochrome, thereby enabling a user to print a document in the most cost effective manner. In addition, the modules can be removed for service or placement in another printing system relatively easily. One disadvantage of a cut sheet printing system is the necessity to handle media sheets as the production throughput requirements are increased. This increase in media sheet handling capability increases the costs and complexity associated with the cut sheet printing system. This added complexity can contribute to a reduction in the overall reliability of the printing system.

The CF format is advantageous for offset print applications because of its media handling ability. One web of media is processed through a print system from the media roll input to the media roll output. The CF format is very reliable because the web is processed through the printing system as one media sheet. However, conventional CF printing systems can require a sizable investment and do not provide the modularity of an integrated cut sheet printing system as described with reference with FIG. 2. In addition, the web or process speed is dependant on the speed of the marking engine(s) process speed. This limit in web speed is driven by the need for a non-slip interface at the image transfer point of the printing system.

This disclosure provides a modular CF printing system to enable a higher web process speed relative to the CF printing system described with reference to FIG. 1.

INCORPORATION BY REFERENCE

U.S. Pat. No. 6,786,149, entitled "HIGH SPPED CONTINUOUS FEEED PRINTING SYSTEM", issued Sep. 7, 2004 to Lomoine et al., the entire disclosure which is incorporated by reference, provides a high speed continuous feed printing system.

BRIEF DESCRIPTION

According to one embodiment, a printing system is provided that includes one or more printing modules, the one or more printing modules comprising a media web transport input; a media web image transfer point; a media web transport output; a primary image transfer system; a secondary image transfer system; and an intermediate image transfer point coupling the primary image transfer system and a secondary image transfer system. The secondary image transfer system is adapted to accept an image from the primary image transfer system at the intermediate image transfer point, and the secondary image transfer system is adapted to transfer the image from the secondary image transfer system to a media web at the media transfer point. The media web transport input and media web transport output provide a media web path to route the media web from the media web transport input to the media web transfer point, and from the media web transfer point to the media web transport output.

According to another embodiment, a method of printing is provided. The method comprising transporting a media web to a first printing module transport input; transporting the media web from the first printing module transport input to an image transfer point; transferring an image from a secondary image transfer system to the media web at the image transfer point; and transporting the media web to a first printing module transport output from the image transfer point subsequent to the image being transferred to the media web. The secondary image transfer system is adapted to accept an image from a primary image transfer system at an intermediate image transfer point and the primary image system transfers an image to the secondary image transfer system at a speed less than the speed of the image being transferred to the media web.

According to another embodiment, a xerographic printing system is provided. The xerographic printing system includes two or more horizontally aligned printing modules, each printing module comprising a media web transport input; a media web image transfer point; a media web transport output; a primary image transfer system; a secondary image transfer system; and an intermediate image transfer point. The intermediate image transfer point coupling the primary image transfer system and secondary image transfer system. The secondary image transfer system is adapted to accept an image from the primary image transfer system at the intermediate image transfer point, and the secondary image transfer system is adapted to transfer the image from the secondary image transfer system to a media web at the media transfer point. The media web transport input and media web transport output provide a media web path to route the media web from the media web transport input to the media web transfer point, and from the media web transfer point to the media web transport output. The two or more horizontally aligned printing modules provide a continuous media path web from the media web transport input of a first end printing module to the media web transport output of a second end printing module, wherein any printing modules positioned between the first end printing module and the second end printing module are aligned to provide a continuous media web path between the first end printing module and the second end printing module.

DETAILED DESCRIPTION

Figure 4:
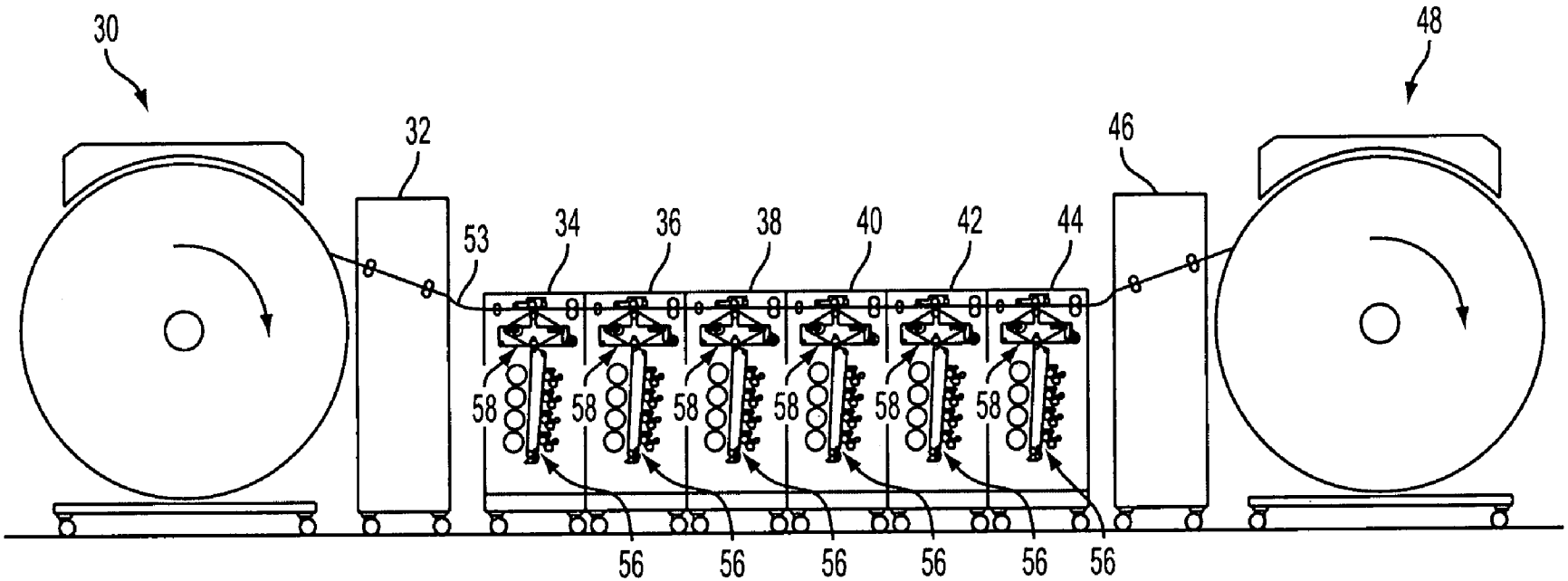
FIG. 4 illustrates a CF printing system according to an exemplary embodiment.

With reference to FIG. 4, illustrated is a CF printing system according to an exemplary embodiment of this disclosure. This printing system includes an input media roll 30, a media web input adapter 32, six modular printing modules 34, 36, 38, 40, 42, and 44, a media web output adapter 46 and an output media roll 48. FIG. 4 illustrates six modular printing modules; however, many other combinations are possible. For example, it may be desirable to only use two integrated printing modules or possibly ten printing modules. In general, the number of printing modules incorporated into the CF printing system represented by FIG. 4 is not limited. Moreover, the printing modules can include printing modules of various capabilities. For example, printing module one may be a black text only printing module, printing module two may be a color printing module, printing module three may be a monochrome printing module, printing module four may be a custom color printing module, etc.

Figure 1:
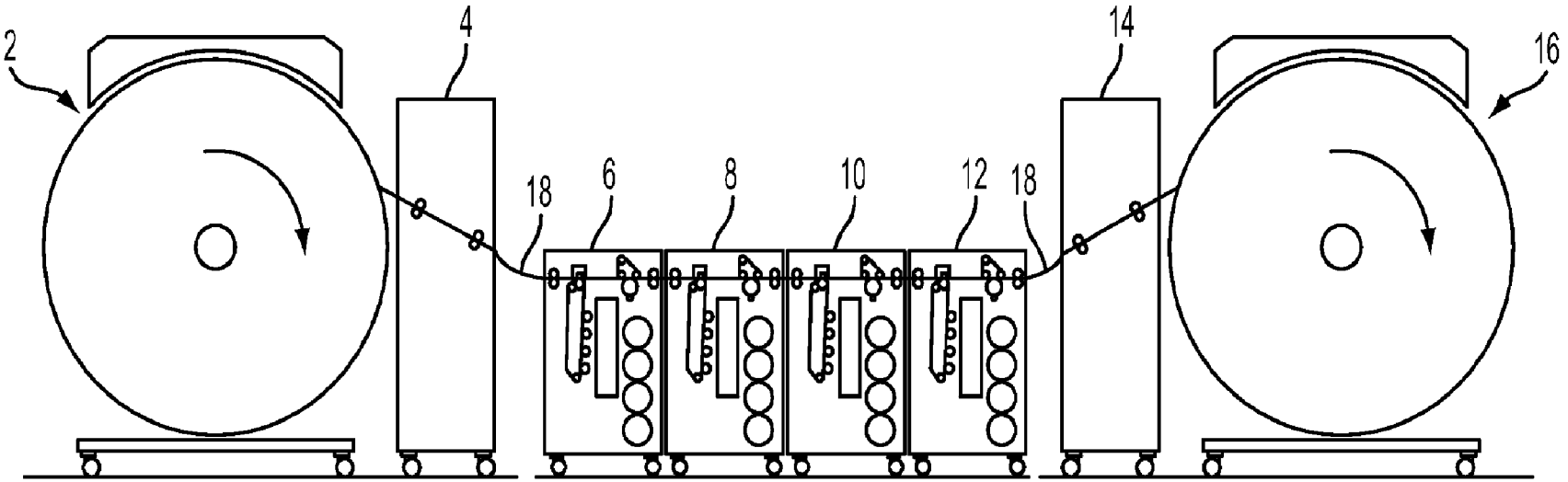
FIG. 1 PRIOR ART
FIG. 1 illustrates a modular CF printing system.
Figure 2:
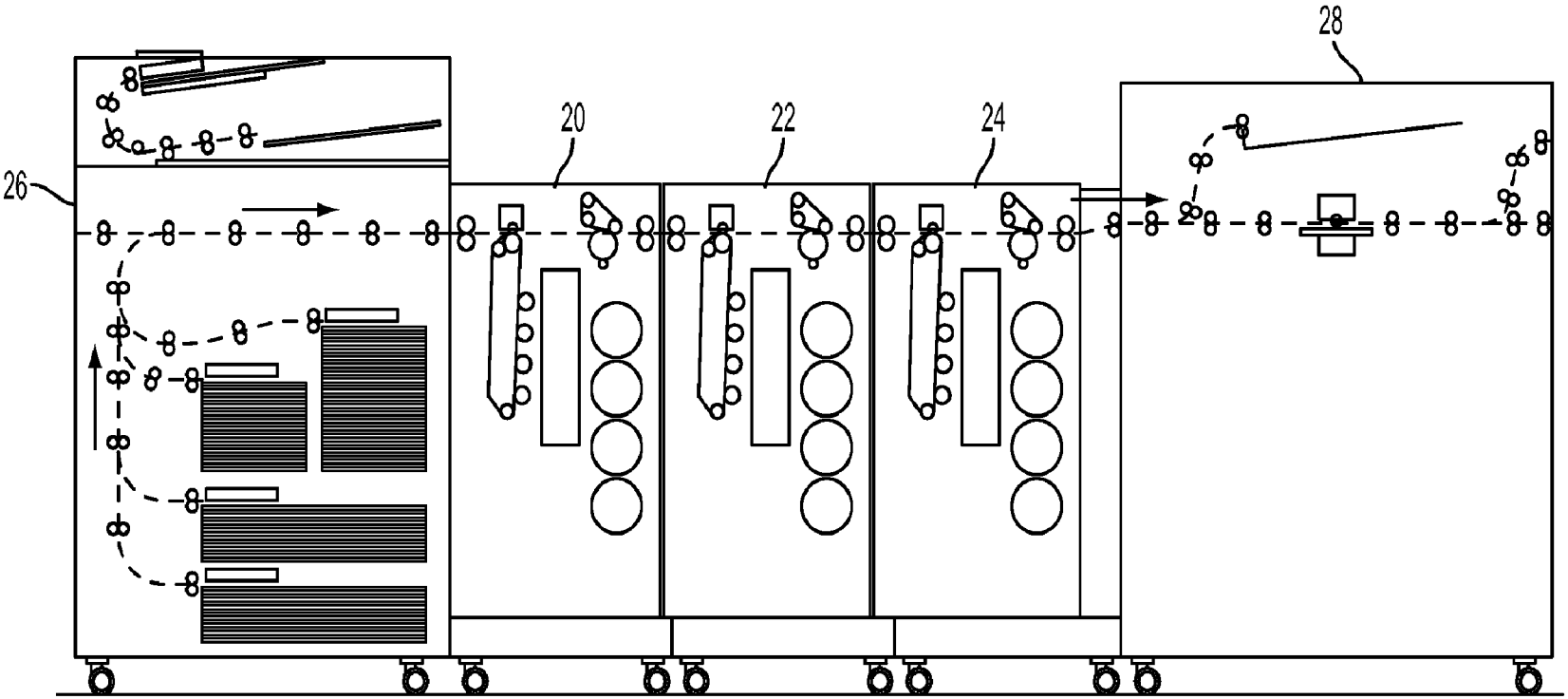
FIG. 2 PRIOR ART
FIG. 2 illustrates a cut sheet printing system.
Figure 3:
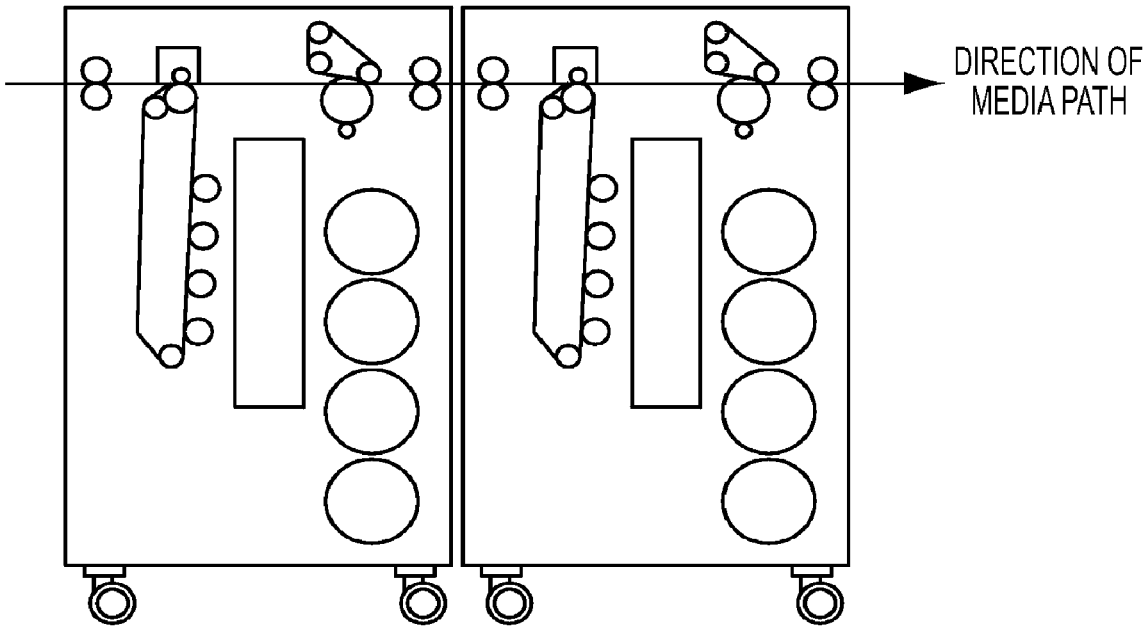
FIG. 3 PRIOR ART
FIG. 3 illustrates two printing modules horizontally aligned.

To provide an increased media web speed, as compared to a CF printing system as illustrated in FIG. 1, the CF printing system printing modules of FIG. 4 each include a secondary image transfer system 58 to decouple the relatively slow primary image transfer system 56 from the relatively high speed media web. In general, the secondary image transfer system 58 operates at the primary image transfer system 56 speed to accept an image. Subsequently, the secondary image transfer system 58 accelerates to the speed of the media web 53 and transfers the image to the media web 53 at a greater speed than the primary image transfer system 56 speed. After the image is transferred to the media web 53, the secondary image transfer system 58 decouples from the media web 53 and decelerates to the speed of the primary image transfer system 56 and accepts another image from the primary image transfer system 56.

The overall process speed of the CF printing system described with reference to FIG. 4 is increased by adding more printing modules. As printing modules are added to the CF printing system, the web 53 speed is only limited by the image transfer speed of the secondary image transfer system 58 and other mechanical limitations relative to the media web handling ability of the system.

The overall operation of the CF printing system of FIG. 4 is now described. An input media roll 30 provides the media web 53 for printing. Typically, the media web 53 format is 18"-19" wide, permitting 2-up letter size printing. However, the embodiments disclosed are not limited by the media roll width. This media web roll is fed through a media web input adapter 32 to feed the input media roll 30 to a first end printing module 34. The media web 53 continues to be fed through a series of integrated printing modules 36, 38, 40, 42, and 44 which include a secondary image transfer system 58. A media web output adapter 46 accepts the media web from the second end printing module 44 and feeds the media web to an output media roll 48. In operation, the input media roll 30 rotates clockwise to unroll the media for printing and the output media roll 48 rotates clockwise to spool the printed media. Variations of roll positions relative to the printing modules and roll rotation direction are possible. In addition, other configurations for adapting the media web 53 to be accepted by the printing modules 34, 36, 38, 40, 42, and 44 and for adapting the printed media web 53 to be rolled on the output media roll 48 are possible and known to those of skill in the art.

As the media web is processed through the printing modules 34, 36, 38, 40, 42, and 44, image marking is accomplished at the processing speed of the media web. A controller (not shown) may be integrated with the CF printing system to control the overall operation of the system, including the timing of each printing module 34, 36, 38, 40, 42, and 44, as related to its image transfer to the media web 53. By controlling the timing of the printing modules, maximum web speed can be achieved and overlay printing can be accomplished. To achieve maximum web speed, multiple printing modules can cooperatively transfer images onto the media web 53, thereby producing a completely filled media web 53. This cooperative transfer of images requires transferring image files to the appropriate printing modules at the correct time for proper sequencing of the transformed images on the media web 53. Overlay printing is accomplished by sequential printing of multiple images on a particular area or page of the media web 53. For example, printing module one 34 may print black text on a specific page of the media web 53 and printing module four 40 may print a color logo on the same page or area of the media web 53. The net result will be an overlay printed product.

Figure 5:
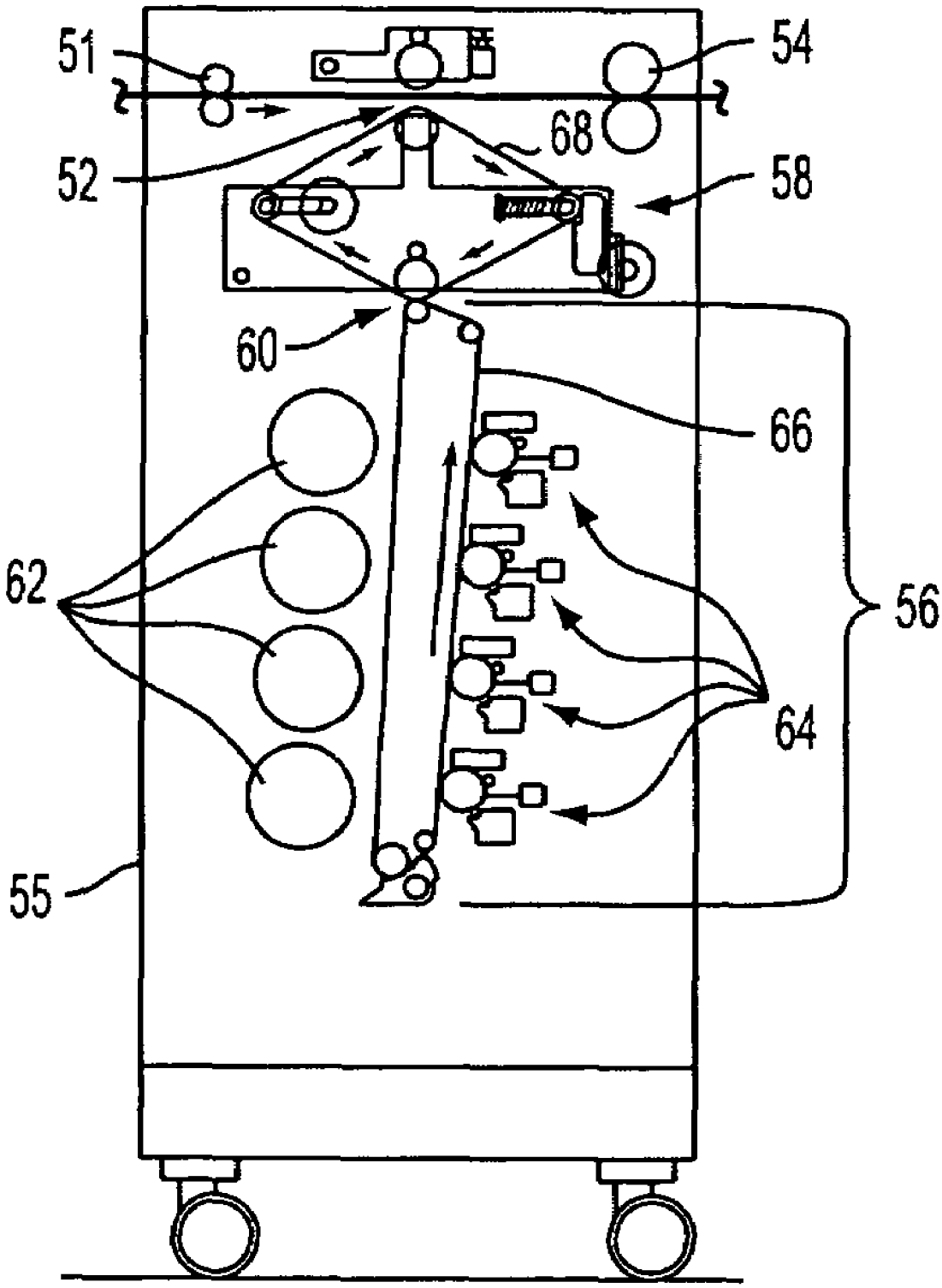
FIG. 5 illustrates a printing module according to one exemplary embodiment.

With reference to FIG. 5, a more detailed description of the printing modules 34, 36, 38, 40, 42, and 44 is provided. The exemplary printing module includes a frame 55 which houses the printing module members. The frame can be segregated into one or more parts which independently house separate functions of the printing module. A multiple frame structure provides additional modularity or flexibility for the overall CF printing system. In addition, the exemplary printing module illustrated in FIG. 5 includes a media web transport input 51, a media web image transfer point 52, a media web transport output 54, a primary image transfer system 56, a secondary image transfer system 58 and an intermediate image transfer point 60 to couple the primary and secondary image transfer systems. The printing module of FIG. 5 also includes four toner supply containers 62 and photoreceptors 64. The number and type of toner supply containers 62 are selected depending on the printing capability desired. For example, four toners supply containers 62 enable CMYK color printing, however, for black text printing, only one toner supply container 62 is required.

Figure 6:
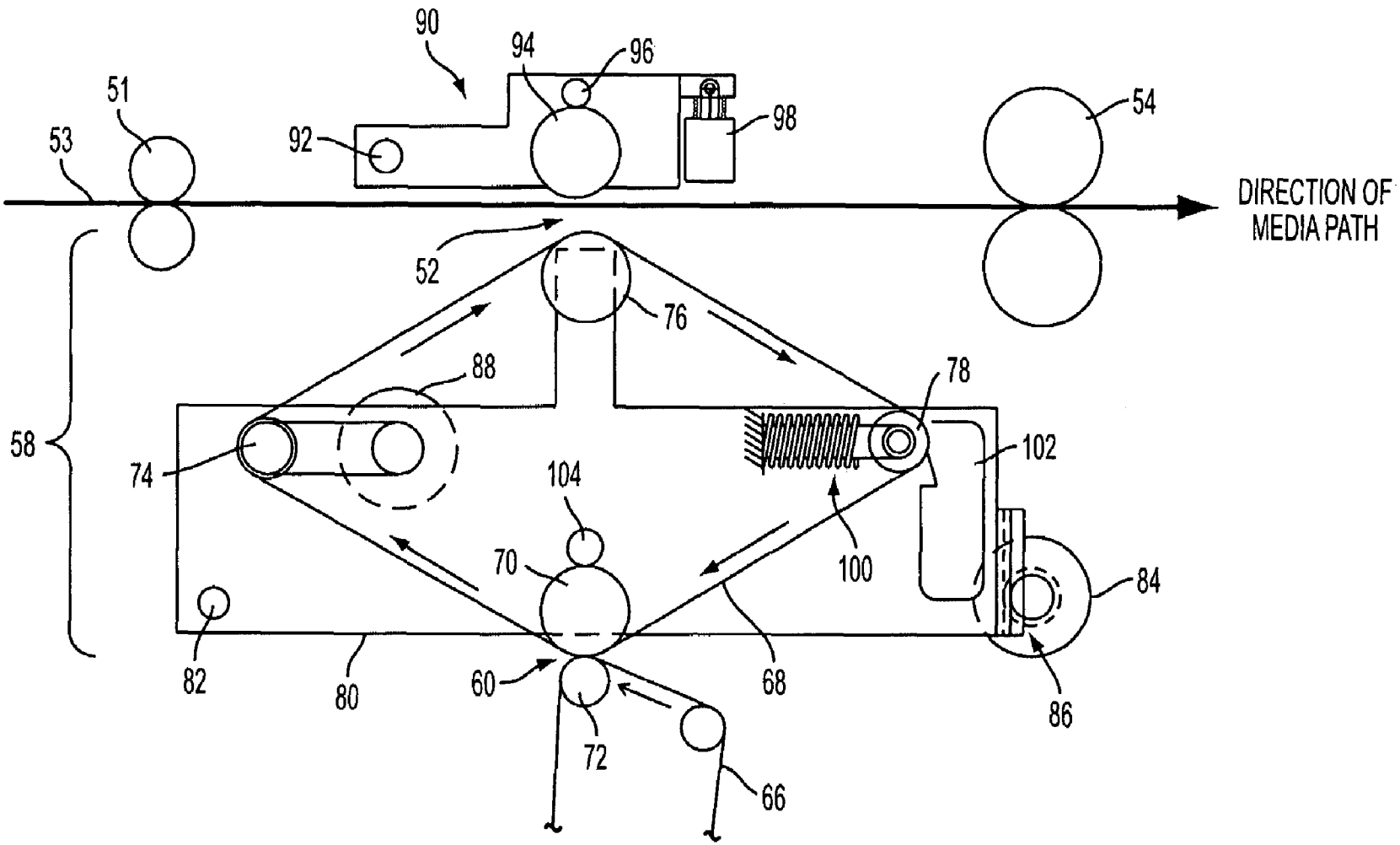
FIG. 6 illustrates an image transfer system according to one exemplary embodiment.

The electronic xerographic printing system operates by the primary image belt 66 accepting color separation images from each of the four photoreceptor modules. The primary image belt 66 subsequently transports the resultant 4-later image to the intermediate transfer point 60. An image transfer is completed at the intermediate image transfer point 60 coupling the primary image transfer system 56 and secondary image transfer system 58. As illustrated in FIG. 5, the primary image transfer belt 66 and a secondary image transfer belt 68 are driven such that the belts are in contact at the intermediate image transfer point 60. The belts are driven in the same direction and at the same speed. As illustrated in FIG. 6, the primary and secondary image transfer belts 66 and 68 respectively, are routed between a bias transfer roll 70 housed within the secondary image transfer system 58 and a roll 72 mounted within the primary image transfer system.

A drive roll 74 drives the secondary image transfer belt 68 at the primary image transfer belt 66 speed to accomplish the image transfer. In addition to the bias roll 70 and drive roll 74, in one exemplary embodiment the secondary image transfer belt 68 is routed along a fixed idler roll 76 and a tension roll 78, respectively. The rolls are mounted to a frame 80 which includes a frame pivot point 82 and is adapted to pivot about the frame pivot point 82. After the image has been transferred to the secondary image transfer belt 68, the frame 80 is pivoted upwardly to decouple the primary and secondary image transfer belts. One exemplary embodiment includes an electromechanical pivot motor 84 and gear assembly 86 attached to the frame for actuating an upward movement of the frame 80. With the image transferred to the secondary image transfer belt 68, the drive roll 74 is driven by an electromechanical drive motor 88 to the speed of the media web. The secondary image transfer system frame 80 is pivoted upwardly to couple the media web 53 and secondary image transfer belt 68 for transferring the image to the media at the media web image transfer point 52.

As referenced in FIG. 6, the media web image transfer point 52 includes a top frame structure 90 including a frame pivot point 92, a media web bias transfer roll 94, a bias charge roll 96 and an electromechanical member 98 such as a solenoid mechanism to transfer an image to the media. The media web image transfer frame 90 is pivoted downwardly by the solenoid mechanism 98 toward the secondary image transfer belt 68. The media web 53 runs in contact with the media web bias roll 94 and the secondary image transfer belt 68 to provide the image transfer. Subsequent to this image transfer, the media web transfer frame 90 is pivoted upwardly by the solenoid mechanism 98 and the secondary image transfer frame 80 is pivoted downwardly; these pivot motions disengage or decouple the media web 53 from the image transfer process. Subsequently, the marked media is run through a media web transport output 54 which may include a roller and/or fuser. The media web continues to run at the web speed and may be optionally marked with images using other printing modules integrated with the system.

Subsequent to the disengagement and decoupling of the secondary image transfer belt 68 from the media web 53, the secondary image transfer belt 68 is decelerated to the speed of the primary image transfer belt 66 and an image is transferred from the primary image transfer system to the secondary image transfer system as previously described. The image transfer cycles are repeated to provide a continuous feed printing system. Other features that may be incorporated to the secondary image transfer system include a belt tensioning device 100, a belt cleaner 102 and a bias charge roll 104.

Figure 7A:
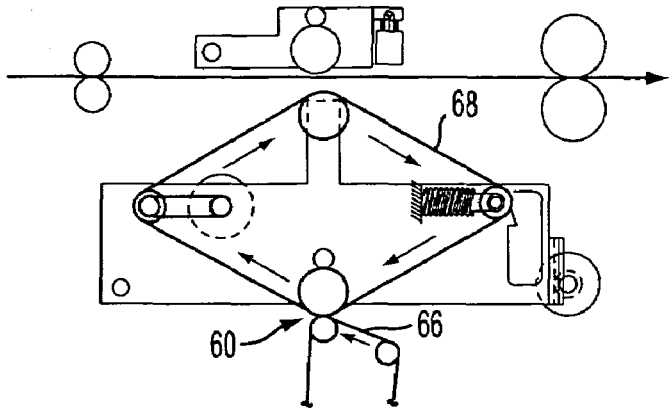
FIGS. 7A, 7B and 7C are detailed representations of the image transfer system illustrated in FIG. 6.
Figure 7B:
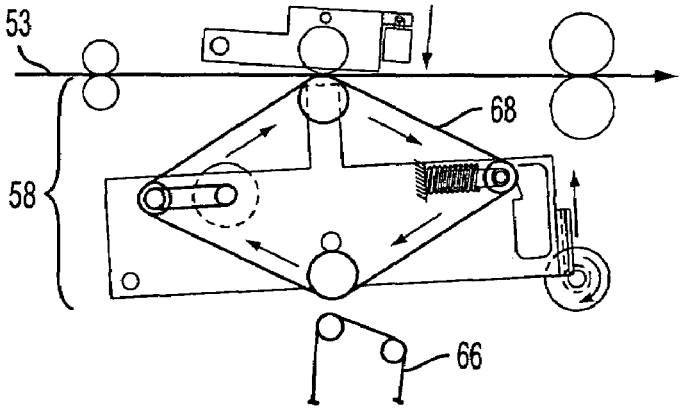
Figure 7C:
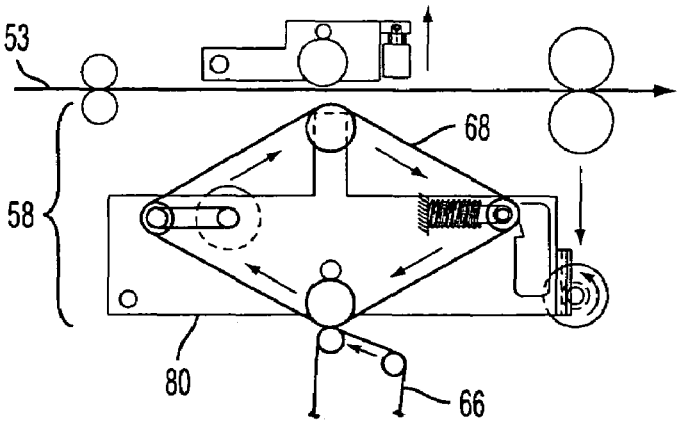

FIGS. 7A, 7B and 7C provide further illustrations to describe the secondary image transfer system 58. Referring to FIG. 7A, this illustration represents the secondary image transfer belt operating at the speed of the primary image transfer belt 66 and accepting an image at the transfer point 60. FIG. 7B illustrates the secondary image transfer system 58 pivoted away from the primary image transfer belt 66 and the secondary image transfer belt 68 accelerated to the media web speed while cooperatively pivoting upwardly against the media web. The media web transfer point frame cooperatively pivots downwardly against the media web. FIG. 7B illustrates the image transfer to the media web. FIG. 70 illustrates the operation of the secondary image transfer system 58 subsequent to the media image transfer to the media web 53. As shown, the frame is pivoted downwardly, the secondary image transfer belt 68 is decelerated to the speed of the primary image transfer belt 66, and the primary and secondary image transfer belts are in contact for the next image transfer. In addition, the media web transfer frame 80 is pivoted upwardly to decouple/disengage from the media web 53.

Figure 8:
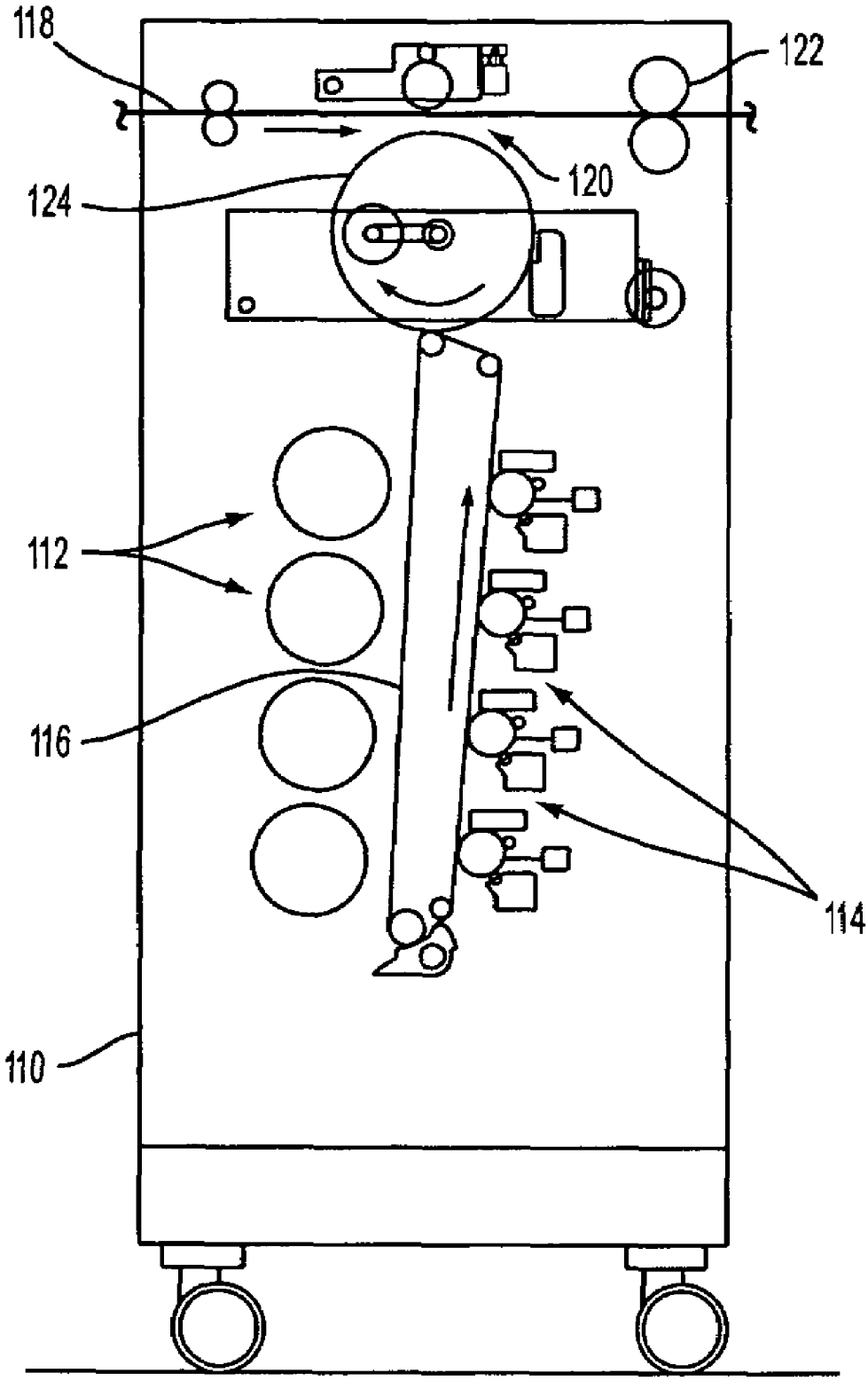
FIG. 8 illustrates a printing module according to another exemplary embodiment.

Referring to FIG. 8, another embodiment of a printing module including a secondary image transfer system is illustrated. This exemplary embodiment includes a frame 110, toner supply containers 112, photo receptor modules 114, a primary image transfer belt 116, a media web input 118, a media web image transfer point 120 and a media web transport output 122. These members were described with reference to FIG. 6. FIG. 8 also includes a secondary image transfer system comprising a drum 124. The drum is an alternative arrangement for the secondary image transfer belt previously described.

Figure 9:
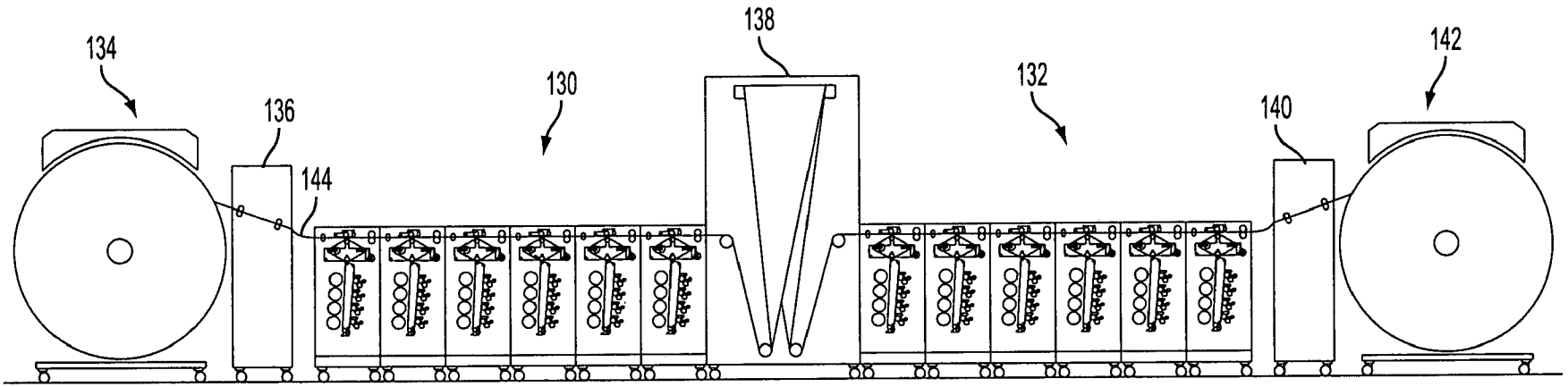
FIG. 9 illustrates a CF duplex printing system according to one exemplary embodiment.

Referring to FIG. 9, a duplex CF printing system is illustrated. This printing system includes two groups of integrated printing modules 130 and 132, an input media roll 134, a media web input adapter 136, a media web inverter 138, a media web output adapter 140 and an output media roll 142. Each group of printing modules marks an image on different sides of the media web. The media web inverter provides the necessary inversion of the media web 144 to provide a duplex CF printing system.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

one or more printing modules, the one or more printing modules comprising:

a media web transport input;

a media web image transfer point;

a media web transport output;

a primary image transfer system;

a secondary image transfer system; and an intermediate image transfer point coupling the primary image transfer system and secondary image transfer system, the secondary image transfer system adapted to accept an image from the primary image transfer system at the intermediate image transfer point, and the secondary image transfer system adapted to transfer the image from the secondary image transfer system to a media web at the media transfer point, wherein the media web transport input and media web transport output provide a media web path to route the media web from the media web transport input to the media web transfer point, and from the media web transfer point to the media web transport output, and the printing system is configured to control transferring the image from the primary image transfer system to the secondary image transfer system at a first tangential speed and transferring the image from the secondary image transfer system to the media web at a second tangential speed relatively greater than the first tangential speed.

2. The printing system according to claim 1, further comprising:

two or more printing modules aligned to provide a continuous media path web from the media web transport input of a first end printing module to the media web transport output of a second end printing module, wherein any printing modules positioned between the first end printing module and the second end printing module are aligned to provide a continuous media web path between the first end printing module and the second end printing module.

3. The printing system according to claim 2, wherein the two or more printing modules are horizontally aligned.

4. The printing system according to claim 2, further comprising:

an input media roll;

an output media roll; and a media rolled on the input media roll, wherein the printing system is adapted to feed the media to the first end printing module and at least one of the two or more printing modules marks the media, and the output media roll is adapted to accept the marked media from the second end printing module media web transport output.

5. The printing system according to claim 4, further comprising:

a media web input adapter to feed the media from the input media roll to the first end printing module; and a media web output adapter to accept the marked media from the second end printing module.

6. The printing system according to claim 5, wherein the input media roll rotates to feed media to the media web input adapter and the output media roll rotates to accept the marked media from the media web output adapter.

7. The printing system according to claim 1, the media web image transfer point further comprising:

a frame;

a bias transfer roll mounted to the frame;

a bias charge roll mounted to the frame, the bias charge roll contacting the bias transfer roll;

a frame pivot point; and an electromechanical actuator, wherein the electromechanical actuator provides movement of the frame and pivots the frame about the frame pivot point.

8. The printing system according to claim 1, the media web transport output further comprising:

a fuser.

9. The printing system according to claim 1, the primary image transfer system further comprising:

a primary image transfer belt;

one or more photoreceptor modules; and one or more toner supply containers, wherein the toner supply containers and photoreceptor modules provide an image to the primary image transfer belt and the primary image transfer belt delivers the image to the intermediate image transfer point.

10. The printing system according to claim 1, the secondary image transfer system further comprising:

a frame;

a bias transfer roll mounted to the frame; and a bias charge roll mounted to the frame, the bias charge roll contacting the bias transfer roll;

a frame pivot point;

an electromechanical actuator to provide movement of the frame, the frame pivoting about the frame pivot point;

a fixed idler roll mounted to the frame;

a tension roll;

a drive roll; and a secondary image transfer belt, wherein the secondary image transfer belt contacts the bias transfer roll, the fixed idler roll, the tension roll, and the drive roll.

11. The printing system according to claim 10, further comprising:

a drive motor coupled to the drive roll, the drive motor rotating the drive roll to drive the secondary image transfer belt.

12. The printing system according to claim 10, further comprising:

a secondary image transfer belt cleaner.

13. The printing system of claim 10, wherein the primary image transfer system transfers an image to the secondary image transfer belt near the location of the secondary bias image transfer system transfer roll.

14. The printing system of claim 13, further comprising:

a media web positioned near the media transfer point, wherein the secondary image transfer belt transfers the image to the media web near the location of the fixed idler roll.

15. The printing system of claim 14, wherein the primary image transfer system comprises a belt and the belt is driven at the first tangential speed, the secondary image transfer belt is driven at the first speed to accept an image from the primary image transfer belt, and the secondary image transfer belt is driven at the second tangential speed to transfer the image to the media web.

16. The printing system of claim 15, wherein the media web is driven at a web tangential speed greater than the first tangential speed, and the secondary image transfer system pivots away from the intermediate image transfer point after accepting the image from the primary image transfer belt, the secondary image transfer belt subsequently accelerating to the web tangential speed and transferring the image to the media web at the media web transfer point.

17. The printing system of claim 16, the media web image transfer point further comprising:

a frame;

a bias transfer roll mounted to the frame; and a bias charge roll mounted to the frame, the bias charge roll contacting the bias transfer roll;

a frame pivot point;

an electromechanical actuator to provide movement of the frame, the frame pivoting about the frame pivot point;

a fixed idler roll mounted to the frame;

a tension roll;

a drive roll; and a secondary image transfer belt, wherein the secondary image transfer belt contacts the bias transfer roll, the fixed idler roll, the tension roll, and the drive roll; wherein the media web image transfer point bias transfer roll cooperatively pivots against the media web while the secondary image transfer system pivots against the media web to transfer the image from the secondary image transfer belt to the media web.

18. The printing system of claim 17, wherein the secondary image transfer system and the media web image transfer point bias transfer roll pivot away from the media web after the image is transferred to the media web, and subsequently the secondary image transfer belt is driven at the primary image transfer belt tangential speed to accept a second image from the primary image transfer belt.

19. The printing system according to claim 1, the one or more printing modules portioned to include an upper fixed media web handling portion and a lower removable image transfer system.

20. The printing system according to claim 1, the secondary image transfer system further comprising:

a rotating drum, wherein the primary image transfer system is adapted to transfer an image to the rotating drum and the rotating drum is adapted to transfer the image to a media web.

21. The printing system according to claim 1, further comprising:

a first and a second group of two or more printing modules, each group of two or more printing modules aligned to provide a continuous media path web from the media web transport input of a first end printing module to the media web transport output of a second end printing module, wherein any printing modules positioned between the first end printing module and the second end printing module are aligned to provide a continuous media web path between the first end printing module and the second end printing module;

a media web inversion module;

an input media roll;

an output media roll' a media rolled on the input media roll, wherein the printing system is adapted to feed the media to the first printing module of the first group, and at least one of the two or more printing modules of the first group marks the media on a first side, and the media web inversion module is adapted to accept the marked media from the second and printing module media web transport output and the web inversion module is adapted to invert the media and feed the first end printing module of the second group, and at least one of the two or more printing modules of the second group marks the media on a second side, and the output media roll is adapted to accept the marked media from the second end printing module media web transport output of group two.

22. The printing system according to claim 1, further comprising:

a media web;

a primary image transfer belt; and a secondary image transfer belt, wherein the primary mage transfer belt is driven at a first tangential speed, the secondary image transfer belt is driven at the first tangential speed to accept an image from the primary image transfer belt, and the secondary image transfer belt is driven at a second tangential speed to transfer the image to the media web.

23. The printing system according to claim 22, wherein the media web is driven at a web tangential speed greater than the first tangential speed, and the secondary image transfer system pivots away from the intermediate image transfer point after accepting the image from the primary image transfer belt, the secondary image transfer belt subsequently accelerating to the web tangential speed and transferring the image to the media web at the media web transfer point.

24. A method of printing, comprising:

transporting a media web to a first printing module transport input;

transporting the media web from the first printing module transport input to an image transfer point;

transferring at the web tangential speed an image from a secondary image transfer system to the media web at the image transfer point; and transporting the media web to a first printing module transport output from the image transfer point subsequent to the image being transferred to the media web, wherein the secondary image transfer system is adapted to accept an image from a primary image transfer system at an intermediate image transfer point where the primary image system transfers an image to the secondary image transfer system at a tangential speed less than the tangential web speed of the image being transferred to the media web, and the secondary image transfer system is adapted to disengage the intermediate image transfer point and accelerate to the web tangential speed.

25. The method according to claim 24, further comprising;

transporting the media web from the first printing module transport output to a second printing module transport input;

transporting the media web from the second printing module transport input to an image transfer point;

transferring an image from a secondary image transfer system to the media web at the image transfer point; and transporting the media web to a second printing module transport output from the image transfer point subsequent to the image being transferred to the media web, wherein the secondary image transfer system is adapted to accept an image from a primary image transfer system at an intermediate image transfer point and the primary image system transfers an image to the secondary image transfer system at a speed less than the speed of the image being transferred to the media web.

26. A xerographic printing system comprising:

two or more horizontally aligned printing modules, each printing module comprising:

a media web transport input;

a media web image transfer point;

a media web transport output;

a primary image transfer system;

a secondary image transfer system;

an intermediate image transfer point coupling the primary image transfer system and secondary image transfer system, the secondary image transfer system adapted to accept an image from the primary image transfer system at the intermediate image transfer point, and the secondary image transfer system adapted to transfer the image from the secondary image transfer system to a media web at the media transfer point, wherein the media web transport input and media web transport output provide a media web path to route the media web from the media web transport input to the media web transfer point, and from the media web transfer point to the media web transport output, wherein the two or more horizontally aligned printing modules provide a continuous media path web from the media web transport input of a first end printing module to the media web transport output of a second end printing module, wherein any printing modules positioned between the first end printing module and the second end printing module are aligned to provide a continuous media web path between the first end printing module and the second end printing module, and the printing system is configured to control transferring the image from the primary image transfer system to the secondary image transfer system at a first tangential speed and transferring the image from the secondary image transfer system to the media web at a second tangential speed relatively greater than the first tangential speed.

27. The xerographic printing system according to claim 26, further comprising:

an input media roll;

an output media roll;

a media rolled on the input media roll, wherein the printing system is adapted to feed the media to the first end printing module and at least one of the two or more printing modules marks the media, and the output media roll is adapted to accept the marked media from the second end printing module media web transport output;

a media web input adapter to feed the media from the input media roll to the first end printing module; and a media web output adapter to accept the marked media from the second end printing module.

28. The xerographic printing system according to claim 27, the secondary image transfer system further comprising:

a frame;

a bias transfer roll mounted to the frame; and a bias charge roll mounted to the frame, the bias charge roll contacting the bias transfer roll;

a frame pivot point;

an electromechanical actuator to provide movement of the frame, the frame pivoting about the frame pivot point;

a fixed idler roll mounted to the frame;

a tension roll;

a drive roll; and a secondary image transfer belt, wherein the secondary image transfer belt contacts the bias transfer roll, the fixed idler roll, the tension roll, and the drive roll.

* * * * *